US006712440B2

(12) United States Patent
Shoji

(10) Patent No.: US 6,712,440 B2
(45) Date of Patent: Mar. 30, 2004

(54) INK-JET PRINTING APPARATUS AND PRINT TIMING SETTING METHOD FOR THE APPARATUS

(75) Inventor: Michiharu Shoji, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/232,329

(22) Filed: Sep. 3, 2002

(65) Prior Publication Data

US 2003/0043220 A1 Mar. 6, 2003

(30) Foreign Application Priority Data

Sep. 6, 2001 (JP) ..... 2001-270461

(51) Int. Cl.[7] ..... B41J 29/38; B41J 23/00
(52) U.S. Cl. ..... 347/14; 347/37
(58) Field of Search ..... 347/37, 14, 19, 347/10, 11

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 6,419,338 | B1 * | 7/2002 | Ikeda | 347/14 |
| 6,471,319 | B1 * | 10/2002 | Adkins et al. | 347/11 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |

* cited by examiner

*Primary Examiner*—Thinh Nguyen
(74) *Attorney, Agent, or Firm*—Fitzpatrick, Cella, Harper & Scinto

(57) ABSTRACT

An ink-jet printing apparatus, which performs printing by reciprocally scanning a carriage, incorporating a printhead, relative to a print medium, comprises a detection unit for outputting a detection signal in accordance with a predetermined distance of a carriage movement in a carriage scanning direction. In this ink-jet printing apparatus, a timing signal is generated in correspondence with a period of the detection signal; a time interval of the detection signal is timed; a ratio between the time interval of the detection signal and a delay time of the timing signal is stored in a memory as reciprocal registration adjustment information; a delay time of the timing signal is obtained based on the information read out from the memory and the time interval of the detection signal when performing printing in a backward scan; a delay signal obtained by delaying the timing signal is outputted in accordance with the delay time; and the printhead is driven in accordance with the delay signal. Accordingly, registration adjustment which is not influenced by variations of a scanning speed is possible in reciprocal printing.

15 Claims, 6 Drawing Sheets

INK-JET PRINTING APPARATUS AND PRINT TIMING SETTING METHOD FOR THE APPARATUS

FIELD OF THE INVENTION

The present invention relates to an ink-jet printing apparatus and a print timing setting method for the apparatus, and more particularly, to print timing setting for an ink-jet printing apparatus which performs printing by scanning a carriage incorporating a printhead discharging ink relative to a print medium and which comprises an encoder outputting a detection signal in accordance with a predetermined distance of a carriage movement in a carriage scanning direction.

BACKGROUND OF THE INVENTION

As a data output apparatus employed in, for instance, word processors, personal computers, facsimiles or the like, printers printing desired information, such as characters and images, on a sheet-type print medium, e.g., paper, film or the like, are widely used.

For a printing method of such printers, various printing methods are known. Particularly, an ink-jet printing method recently receives attention because of its capability to perform printing without contacting a print medium such as paper, ease of color printing, and quiet printing operation. In general, such printers widely adopt a serial printing method because of its low cost and ease of downsizing. According to the serial printing method, printing is realized by reciprocally scanning a carriage, incorporating a printhead discharging ink in accordance with desired print data, in the direction orthogonal to the conveyance direction of a print medium such as paper.

Furthermore, recently a printing method called a reciprocal printing or bi-directional printing is adopted to improve printing speed. According to this method, printing is realized by discharging ink from a printhead in both forward and backward directions of a carriage movement relative to a print medium.

FIG. 3 is a view showing a relation between printhead moving speed (scanning speed) and an ink droplet landing position. Described hereinafter is a case where a printhead 301, incorporated in a carriage (not shown), moves in the direction A in FIG. 3 at reference speed V. The distance between the printhead 301 and print medium 305 is d. When the printhead 301 discharges an ink droplet 303 at the position 307 onto the print medium 305 at discharge speed Vd, the ink droplet 303 travels at speed and the direction represented by composite vectors of the reference speed V and discharge speed Vd. The landing position of the ink droplet 303 on the print medium 305 is a position 306, which is deviated in the direction A by a distance δ from the position 307 where the printhead 301 has actually discharged the ink droplet 303.

Assuming that the forward scan of the printhead 301 is the direction A, the backward scan of the printhead 301 is the direction B in a case of performing reciprocal printing. If the printhead 301 discharges ink in the backward scan at the same position as the position 307 where the ink droplet 303 is discharged in the forward scan, the ink droplet 303 lands on a position 310 which is deviated by a distance δ in the direction opposite to the landing position 306 with respect to the position 307. As a result, even if an ink droplet is discharged at the same position in the forward and backward scans, the landing position on the print medium deviates by the distance from 306 to 310, i.e., 2×δ.

In order to eliminate the landing position deviation between the forward and backward scans, the ink-jet printing apparatus performs registration adjustment in reciprocal printing, making use of the fact that an ink droplet is normally discharged in a region where a printhead moves at constant speed. More specifically, the printer is controlled such that it discharges an ink droplet at timing 313 in the backward scan, that is the timing at which a predetermined delay time (delay) 312 is added to the one previous timing 311, instead of the timing 307 that corresponds to the discharge position 307 in the forward scan.

However, recently there are further demands for an improved speed and low cost of printers. In order to meet the demands, attempts have been made to perform printing not only in a region where a printhead moves at constant speed but also in a region where a printhead accelerates or decelerates, or to employ a low-cost motor and components thereof.

In the accelerating and decelerating regions, the printhead moving speed changes. Furthermore, employing a low-cost motor and control components causes cockling of the motor in the constant-speed motion region and causes speed variations due to negatively influenced servo precision. As a result, an ink droplet is discharged in a state where the printhead moving speed varies, and the landing position of the ink droplet deviates from a target position.

When the printhead moving speed varies, landing positions in the forward and backward scans can no longer be adjusted by the registration adjustment using a predetermined delay. Therefore, it is necessary to deviate the landing position of the ink droplet by a predetermined distance. In the region where the printhead moving speed varies, mere delaying of the discharge timing by a predetermined time, as has conventionally been done, still generates an ink landing position deviation for a distance corresponding to the speed variations.

SUMMARY OF THE INVENTION

The present invention has been proposed to solve the conventional problems, and has as its object to provide an ink-jet printing apparatus capable of performing registration adjustment in reciprocal printing even if printhead moving speed varies.

Another object of the present invention is to provide a print timing setting method for an ink-jet printing apparatus capable of performing registration adjustment in reciprocal printing even if printhead moving speed varies.

According to the present invention, the foregoing object is attained by providing an ink-jet printing apparatus performing printing by reciprocally scanning a carriage, incorporating a printhead, relative to a print medium, comprising: detection means for outputting a detection signal in accordance with a predetermined distance of a movement of the carriage in a carriage scanning direction; timing signal output means for generating a timing signal in correspondence with a period of the detection signal; time interval detection means for timing a time interval of the detection signal; memory means for storing as reciprocal registration adjustment information a ratio between the time interval of the detection signal and a delay time of the timing signal; delay time setting means for obtaining a delay time of the timing signal based on the information read out from the memory means and the time interval of the detection signal when performing printing in a backward scan; delay signal output means for outputting a delay signal, obtained by delaying the timing signal, in accordance with the delay time; and driving means for driving the printhead based on the delay signal.

Furthermore, the foregoing object is attained by providing a print timing setting method for an ink-jet printing apparatus, which performs printing by reciprocally scanning a carriage, incorporating a printhead, relative to a print medium and includes detection means for outputting a detection signal in accordance with a predetermined distance of a carriage movement in a carriage scanning direction, comprising the steps of: generating a timing signal in correspondence with a period of the detection signal; timing a time interval of the detection signal; storing as reciprocal registration adjustment information a ratio between the time interval of the detection signal and a delay time of the timing signal in memory means; obtaining a delay time of the timing signal based on the information read out from the memory means and the time interval of the detection signal when performing printing in a backward scan; outputting a delay signal, obtained by delaying the timing signal, in accordance with the delay time; and driving the printhead based on the delay signal.

In other words, according to the ink-jet printing apparatus proposed by the present invention, which performs printing by reciprocally scanning a carriage incorporating a printhead relative to a print medium and includes detection means for outputting a detection signal in accordance with a predetermined distance of a carriage movement in a carriage scanning direction, a timing signal is generated in correspondence with a period of the detection signal, a time interval of the detection signal is timed, a ratio between the time interval of the detection signal and a delay time of the timing signal is stored in memory means as reciprocal registration adjustment information, a delay time of the timing signal is obtained based on the information read out from the memory means and the time interval of the detection signal when performing printing in a backward scan, a delay signal obtained by delaying the timing signal is outputted in accordance with the delay time, and the printhead is driven based on the delay signal.

According to the foregoing construction, since the ratio between the time interval of an encoder detection period and delay time can be made constant, it is possible to set a long delay time when carriage moving speed is slow, and set a short delay time when the speed is fast. Therefore, the amount of ink deviation, from the point of being discharged by the printhead to the point of landing on a print medium, can be made constant at all times based on a signal outputted from the encoder regardless of the printhead scanning speed.

Therefore, registration adjustment which is not influenced by variations of printhead scanning speed is possible in reciprocal printing.

The ratio between the time interval of the detection signal and the delay time of the timing signal may be set constant regardless of speed.

Preferably, the delay time setting means sets the delay time short when the time interval is short, and sets the delay time long when the time interval is long.

In this case, the delay time setting means obtains the delay time by performing a predetermined calculation on the time interval.

Preferably, the predetermined calculation obtains the delay time d by $d=a\times A/n$ (n is an integer), where A is the time interval and a is a predetermined coefficient. Further, n may be a power of 2.

The printhead may be a printhead which discharges ink by utilizing heat energy and comprises a heat energy transducer for generating the heat energy to be applied to ink.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In this specification, the term "print" means not only to form significant information such as characters and graphics, but also to form, e.g., images, figures, and patterns on print media in a broad sense, regardless of whether the information formed is significant or insignificant or whether the information formed is visualized so that a human can visually perceive it, or to process print media.

"Print media" are any media capable of receiving ink, such as cloth, plastic films, metal plates, glass, ceramics, wood, and leather, as well as paper sheets used in common printing apparatuses.

Furthermore, "ink" (to be also referred to as "liquid" hereinafter) should be broadly interpreted like the definition of "print" described above. That is, ink is a liquid which is applied onto a print medium and thereby can be used to form images, figures, and patterns, to process the print medium, or to process ink (e.g., to solidify or insolubilize a colorant in ink applied to a print medium).

Figure 2:
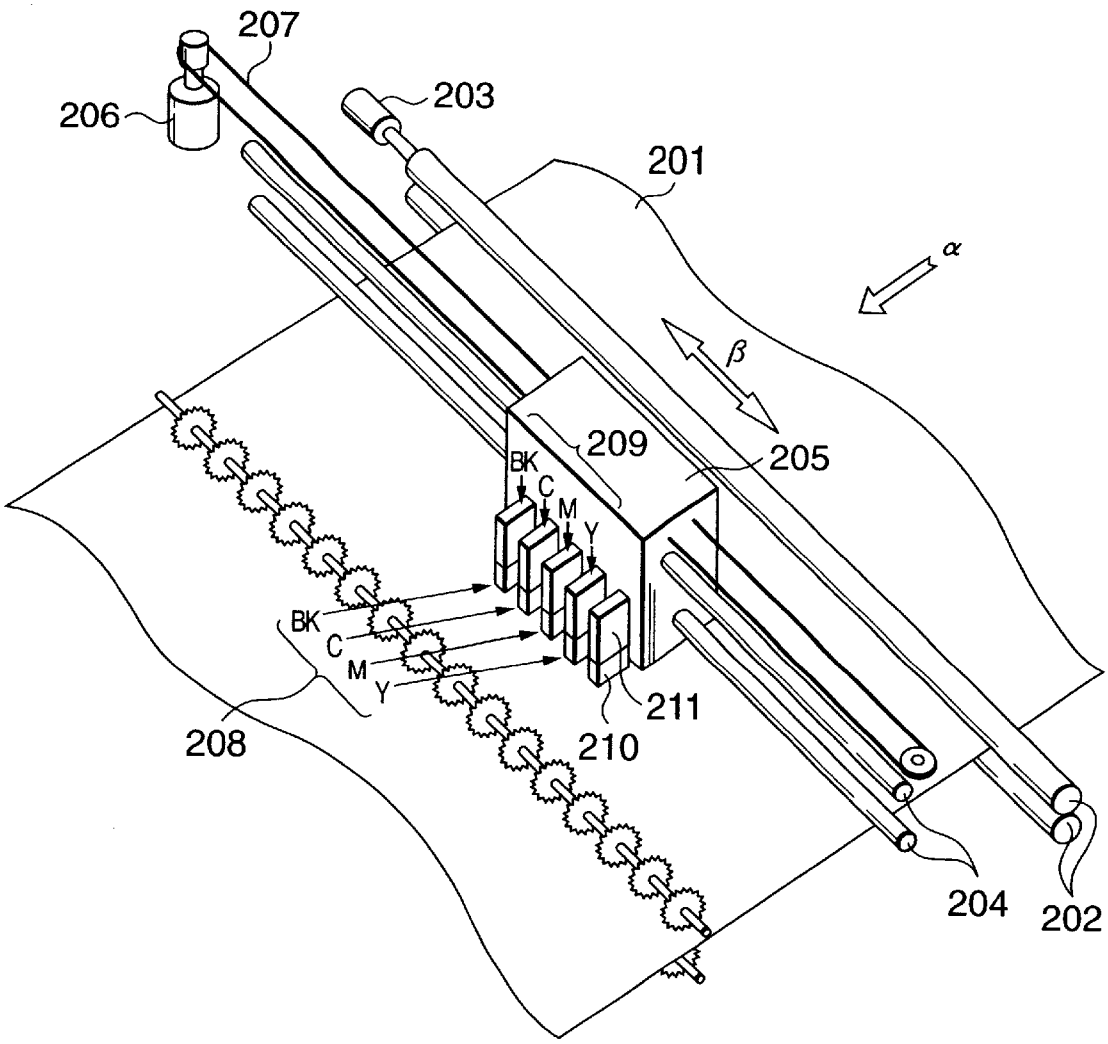
FIG. 2 is a perspective view showing a main construction of an ink-jet printing apparatus, which is related to printing according to the embodiment.
Figure 3:
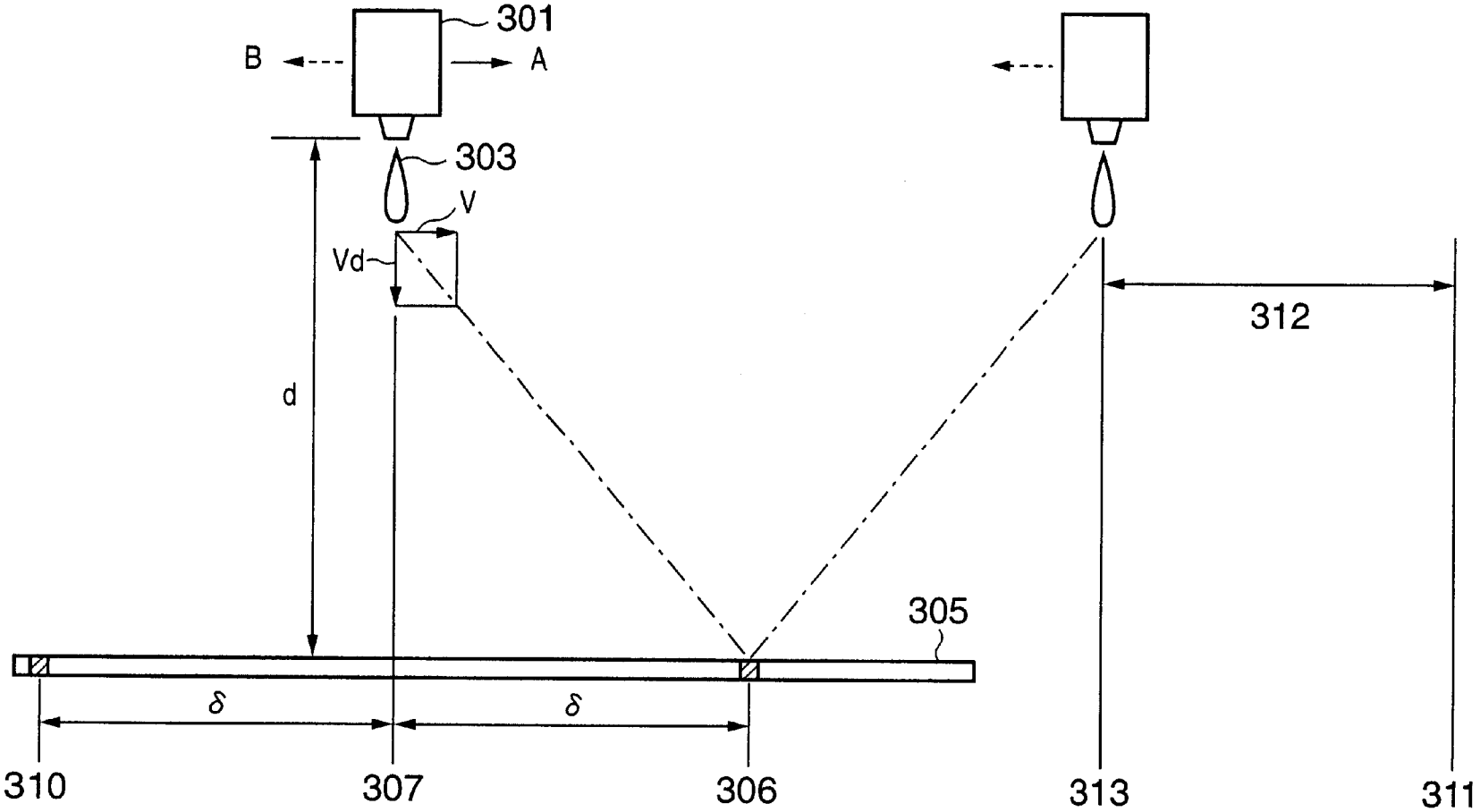
FIG. 3 is a view showing a relation between printhead moving speed and an ink droplet landing position.

First, descriptions are provided with reference to FIG. 2 on the main construction of an ink-jet printing apparatus, which is related to printing according to an embodiment of the present invention.

Referring to FIG. 2, print media 201 are supplied one by one from the right side of the drawing by paper supply means (not shown), and conveyed in the direction indicated by the arrow $\alpha$ while being held by a pair of print medium conveyance rollers 202 rotated by a sheet conveyance motor 203. A stepping motor or a DC motor may be used as the sheet conveyance motor 203. Recently, a DC motor is often employed because it can be driven with low noise. A rotary encoder (not shown) is incorporated in the print medium conveyance roller 202. Based on a pulse signal supplied from the encoder, the driving of the sheet conveyance motor 203 is controlled.

Ahead of the print medium conveyance rollers 202 in the conveyance direction (direction of arrow α), a pair of shafts 204 are arranged in parallel with the print medium conveyance rollers 202. A taut reeled belt 207, driven by a carriage motor 206, is provided above the shaft 204. By driving the belt 207, a carriage 205 is reciprocally moved (scanned) along the shaft in the direction of arrow β. Lubrication oil such as grease is applied to the shaft 204 for the purpose to reduce the mechanical load caused by friction of the carriage 205. As similar to the sheet conveyance motor 203, a stepping motor or a DC motor may be used as the carriage motor 206, but a DC motor is often employed because it can be driven with low noise.

A linear encoder (not shown) comprises: a scale for the linear encoder, having slits at fixed intervals, which is arranged in parallel with the shaft 204; and an optical sensor (not shown) arranged in a position opposite to the scale on the carriage 205. Driving of the carriage motor 206 is controlled based on a pulse signal, corresponding to the width and intervals of the slits of the scale, which is obtained from the linear encoder. A timing signal for discharging ink from the printhead is generated based on a signal obtained from the linear encoder. Details will be described later.

A printhead and an ink tank for supplying ink to the printhead are mounted to the carriage 205. The printhead 208 in FIG. 2 is a color-printing head. In FIG. 2, black (BK), cyan (C), magenta (M), and yellow (Y) printheads are arranged in this order from the left side in the carriage scanning direction. In correspondence with the printheads, black (BK), cyan (C), magenta (M), and yellow (Y) ink tanks 209 are arranged in this order. A black printhead 210 is provided for performing monochrome printing, and an ink tank 211 is provided for supplying black ink to the printhead 210.

On the front surface of the printheads 208 and 210, i.e., the surface opposite to the printing surface of the print medium 201, there are plural (e.g., 48 or 64) ink discharge orifices (nozzles) arranged at fixed intervals (e.g., 0.8 mm) in the direction orthogonal to the carriage scanning direction. Printing is performed by alternately performing scanning, during which ink is selectively discharged from each nozzle while the printhead is moving, and performing conveyance of the print medium 201 between each scan.

Next, the control structure for performing the printing control of the above apparatus is described.

Figure 6:
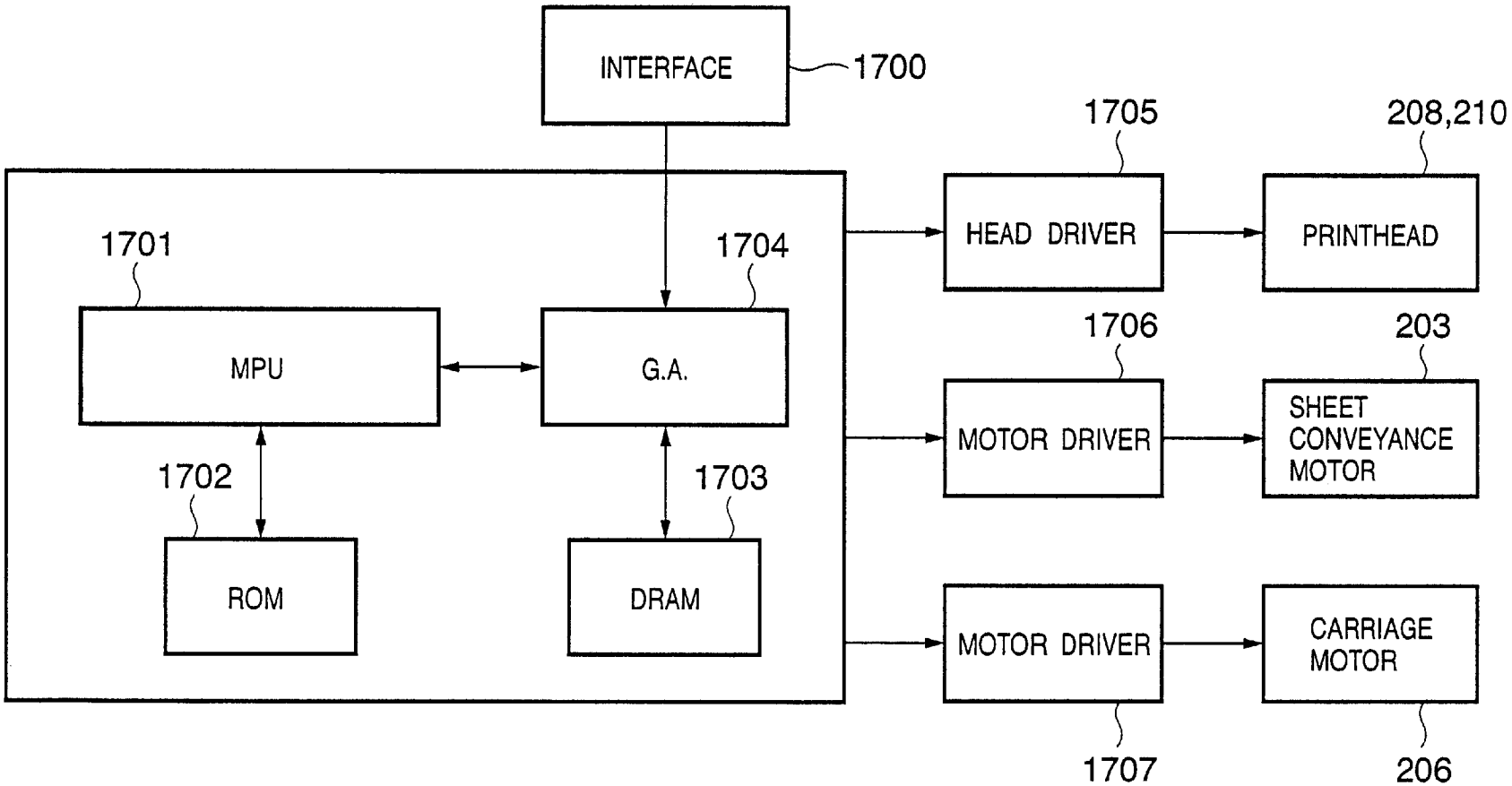
FIG. 6 is a block diagram showing a construction of a control circuit of an ink-jet printing apparatus according to the embodiment.

FIG. 6 is a block diagram showing the arrangement of a control circuit of the ink-jet printing apparatus. Referring to FIG. 6 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printhead, and the like). Reference numeral 1704 denotes a gate array (G.A.) for performing supply control of print data to the printheads 208 and 210. The gate array 1704 also performs data transfer control among the interface 1700, the MPU 1701, and the RAM 1703. Reference numeral 206 denotes a carriage motor for carrying the printheads 208 and 210 in the main scanning direction; and 203, a conveyance motor for conveying a paper sheet. Reference numeral 1705 denotes a head driver for driving the printhead; and 1706 and 1707, motor drivers for driving the conveyance motor 203 and the carriage motor 206.

The operation of the above control arrangement is described below. When a print signal is inputted to the interface 1700, the print signal is converted into print data for a printing operation between the gate array 1704 and the MPU 1701. The motor drivers 1706 and 1707 are driven, and the printhead is driven in accordance with the print data supplied to the head driver 1705, thus performing the printing operation.

Although the control program executed by the MPU 1701 is stored in the ROM 1702, a writable storage medium such as an EEPROM may additionally be provided so that the control program can be altered from a host computer connected to the ink-jet printing apparatus.

Next, controlling the printhead according to this embodiment is described with reference to the block diagram shown in FIG. 1.

Print data transferred from a host 101, such as a personal computer, is received by an I/F unit 103 in a print control unit 102, and transmitted to a print data generator 104. The print data generator 104 performs decompression of compressed data or conversion of data arrays and so on to convert the received data to a data form printable by a printhead 105.

An encoder 109, included in a carriage 108 together with the printhead 105 for being driven by a carriage motor 107, outputs a pulse signal each time the carriage 108 moves for a predetermined distance. The pulse signal generated by the encoder 109 is sent to a LPF 110 in the print control unit 102 to remove noise, and transmitted to an edge trigger generator 111. The edge trigger generator 111 detects a predetermined encoder edge and generates a trigger pulse.

The trigger pulse generated by the edge trigger generator 111 is transmitted to a speed detection unit 112 and an edge trigger delay unit 113. The speed detection unit 112 detects intervals of the trigger pulse, generated by the edge trigger generator 111, and transfers the detected value to a reciprocal registration amount calculation unit 114 as information related to the current speed. Also, the information regarding the speed, which has been detected by the speed detection unit 112, is transferred to a servo controller (driver) (not shown) as necessary, which servo-controls the carriage motor 107.

The reciprocal registration amount calculation unit 114 calculates the reciprocal registration adjustment amount (delay value) based on the information regarding the current speed which is transmitted by the speed detection unit 112 and predetermined reciprocal registration adjustment information set in advance as a delay ratio α for an encoder edge interval. The edge trigger delay unit 113 delays the trigger pulse, generated by the edge trigger generator 111, in accordance with the reciprocal registration adjustment amount (delay value) calculated by the reciprocal registration amount calculation unit 114, and outputs the pulse to a print timing generator 115. For instance, in a case where an encoder edge interval is τ, a delay time t is calculated (the ratio $\alpha=t/\tau$). When the carriage speed doubles, the encoder edge interval becomes τ/2. Therefore, the delay time is calculated by t/2 based on the ratio α.

Note that the value α set as the reciprocal registration adjustment information is obtained by, for instance, performing reciprocal printing at the time of shipping from a factory. The obtained value is stored in a non-volatile memory. For instance, reciprocal printing is performed at predetermined speed (constant speed), and a delay time between a dot printed in a forward scan and a dot printed in a backward scan overlapping with each other is measured to obtain the ratio α. The obtained value is stored in a non-volatile memory such as an EEPROM, and used when calculation is performed in an actual printing operation.

The print timing generator 115 generates a print timing signal based on the delayed trigger pulse, transmitted by the edge trigger delay unit 113, and transmits the signal to a print data transfer unit 106 and a position detection unit 116. The position detection unit 116 detects a position of the carriage 108 by counting with an UP/DOWN counter the information transmitted from the edge trigger delay unit 113 and print timing generator 115.

The position information detected by the position detection unit 116 is transmitted to a print position detection unit 117. When the print position detection unit 117 determines based on the position information that the carriage is at a print starting position, the print position detection unit 117 generates a print starting signal, and when the print position detection unit 117 determines that the carriage is at a print ending position, the print position detection unit 117 generates a print ending signal to be transmitted to the print data transfer unit 106. The print data transfer unit 106 transfers the print data, generated by the print data generation unit 104, to the printhead 105 in accordance with the signals transmitted from the print timing generation unit 115 and print position detection unit 117. The printhead 105 prints an image by discharging ink droplets onto a print medium in accordance with the print data transferred.

Note that the edge trigger delay unit 113 performs the delay processing, assuming that the delay time in the forward scan of the reciprocal printing is zero and the delay time in the backward scan is the registration adjustment amount (delay value) calculated by the reciprocal registration amount calculation unit 114.

The print position detection unit 117 advances the print starting position by one timing (one period of an encoder output signal) in the backward scan as compared to the forward scan. For instance, a value of the above-described UP/DOWN counter is used.

Figure 1:
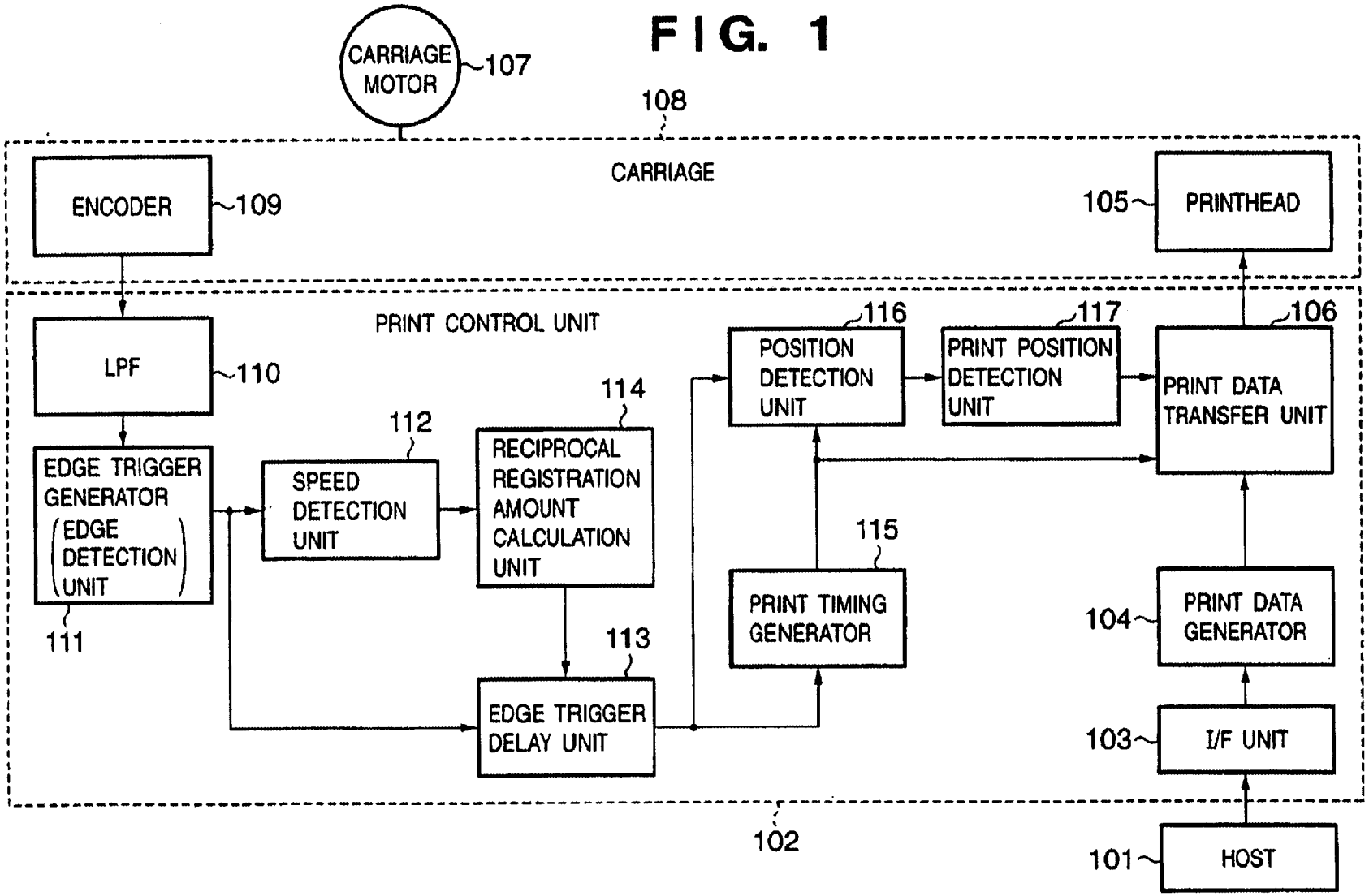
FIG. 1 is a block diagram showing functions related to printhead control according to an embodiment of the present invention.

Furthermore, in FIG. 1, although the print data transfer unit 106 transfers the print data, generated by the print data generation unit 104, to the printhead 105 in accordance with the signals transmitted from the print timing generation unit 115 and print position detection unit 117, the print data and signals transmitted from the print timing generation unit 115 and print position detection unit 117 may be transferred through different paths and a logical AND may be calculated in the printhead.

Figure 4:
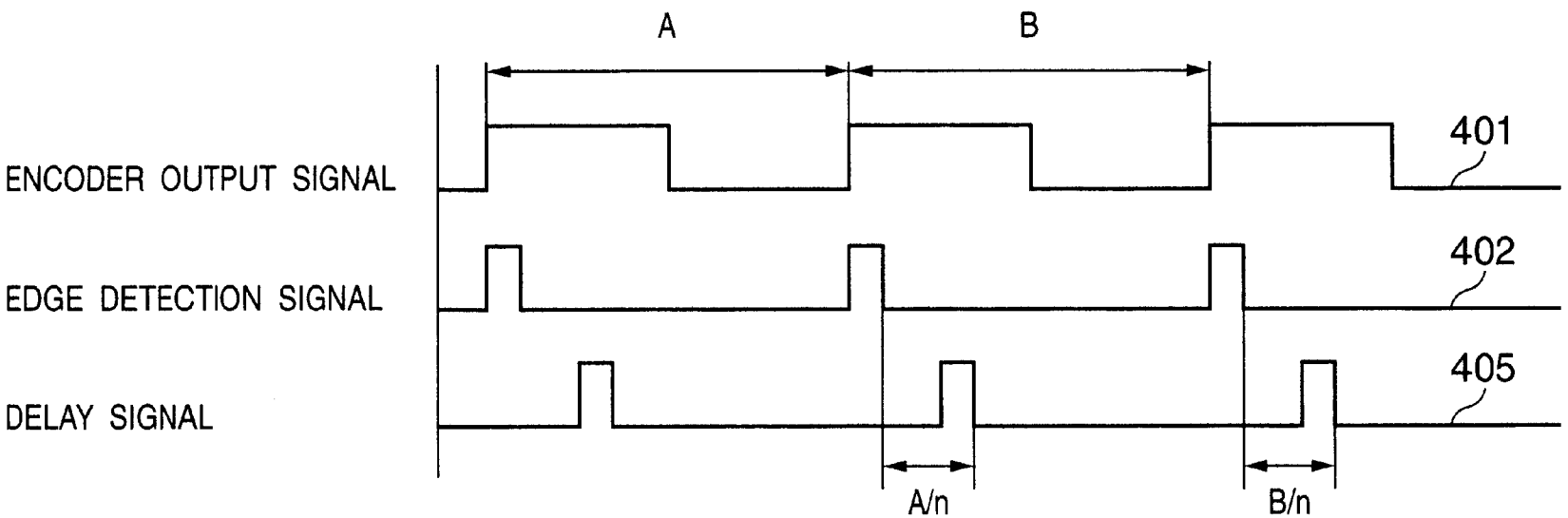
FIG. 4 is a timing chart showing waveforms of signals outputted from respective portions in FIG. 1.

FIG. 4 is a timing chart showing waveforms of a signal outputted from the encoder 109, a signal outputted from the edge trigger generator 111, and a signal outputted from the edge trigger delay unit 113.

The output signal 401 from the encoder 109 is a pulse signal outputted in accordance with the width and intervals of the slits provided on the scale at predetermined intervals. The period of the pulse signal is inversely proportional to the carriage moving speed: the period is short if the speed is fast, whereas the period is long if the speed is slow. The edge detection signal 402 outputted from the edge trigger generator 111 is a pulse signal having a predetermined width, which is outputted in accordance with detection of a rising edge of the encoder output signal 401, according to this embodiment.

The interval of the edge detection signal 402 is obtained by the speed detection unit 112, and outputted to the reciprocal registration amount calculation unit 114 as information related to speed. This information corresponds to the period of the encoder output signal indicated by A and B in FIG. 4. Herein, the reciprocal registration amount calculation unit 114 according to this embodiment calculates 1/n (n is an integer) of the encoder period as a delay value for adjustment. More specifically, A/n is calculated with respect to the encoder period A, and outputted to the edge trigger delay unit 113. In response, the edge trigger delay unit 113 outputs a delay signal 405, that is, the edge detection signal 402 delayed by A/n. Similarly, assuming that an interval of the next edge detection is B, the reciprocal registration amount calculation unit 114 calculates B/n, and the edge trigger delay unit 113 outputs a delay signal 405, that is, the edge detection signal 402 delayed by B/n.

As described above, in a forward scan of reciprocal printing, a delay value is set in a predetermined value (zero). Accordingly, printing can be performed at correct positions based on the edge detection signal 402. In a backward scan of the reciprocal printing, a delay value is calculated based on the time information of a period obtained from an immediately previous encoder period. Accordingly, the driving timing of the printhead can be set in accordance with variations of the carriage moving speed, and the position of a dot discharged in the backward scan can coincide with the position of a dot discharged in the forward scan.

Herein, the integer n used in the aforementioned reciprocal registration amount calculation is a power of 2 because 1/n can be readily calculated by a bit-shift operation. This provides an advantage in that the reciprocal registration amount calculation unit 114 can readily be constructed with hardware.

Furthermore, although the reciprocal registration adjustment amount is T/n (T is a period (interval)) in the above description, it may be T/n multiplied by a predetermined coefficient a, i.e., a×T/n. In this manner, it is easier to vary the delay ratio in accordance with an actual carriage moving speed. For instance, in a case where a printer has print modes of different carriage moving speed (scanning speed), the delay ratio can be varied by changing the coefficient a in accordance with the print mode. From another standpoint, the aforementioned reciprocal registration amount being T/n is the case where the coefficient a is 1.

The processing related to calculating the reciprocal registration amount according to this embodiment is described with reference to the flowchart in FIG. 5. The processing shown in the flowchart is executed by the speed detection unit 112, reciprocal registration amount calculation unit 114, and edge trigger delay unit 113 in FIG. 1, as well as the MPU 1701 in FIG. 6.

When the processing starts (step S501), it is determined whether or not a reciprocal registration function is set (step S502). If not, a predetermined value (zero) is set as the delay value for a forward scan (step S503). Based on the set value, the edge trigger delay unit 113 outputs an edge trigger having no delay time (step S504).

Meanwhile, if a reciprocal registration function is set, it is determined whether or not the current printing is printing in a backward scan (step S506). If the current printing is printing in a forward scan, a predetermined value (zero) is set as the-delay value for the forward scan (step S503), and edge trigger generation is performed (step S504). If it is determined in step S506 that the current printing is printing in a backward scan, A/n is calculated based on the encoder period A obtained by the speed detection unit 112 as the information related to speed, and the obtained value is set as the delay value for the backward scan (step S507). Then, the edge trigger delay unit 113 delays the edge trigger in accordance with the delay value A/n (step S504). Note that although the delay value in the forward scan is zero in the above description, the delay value is not limited to this value.

Figure 5:
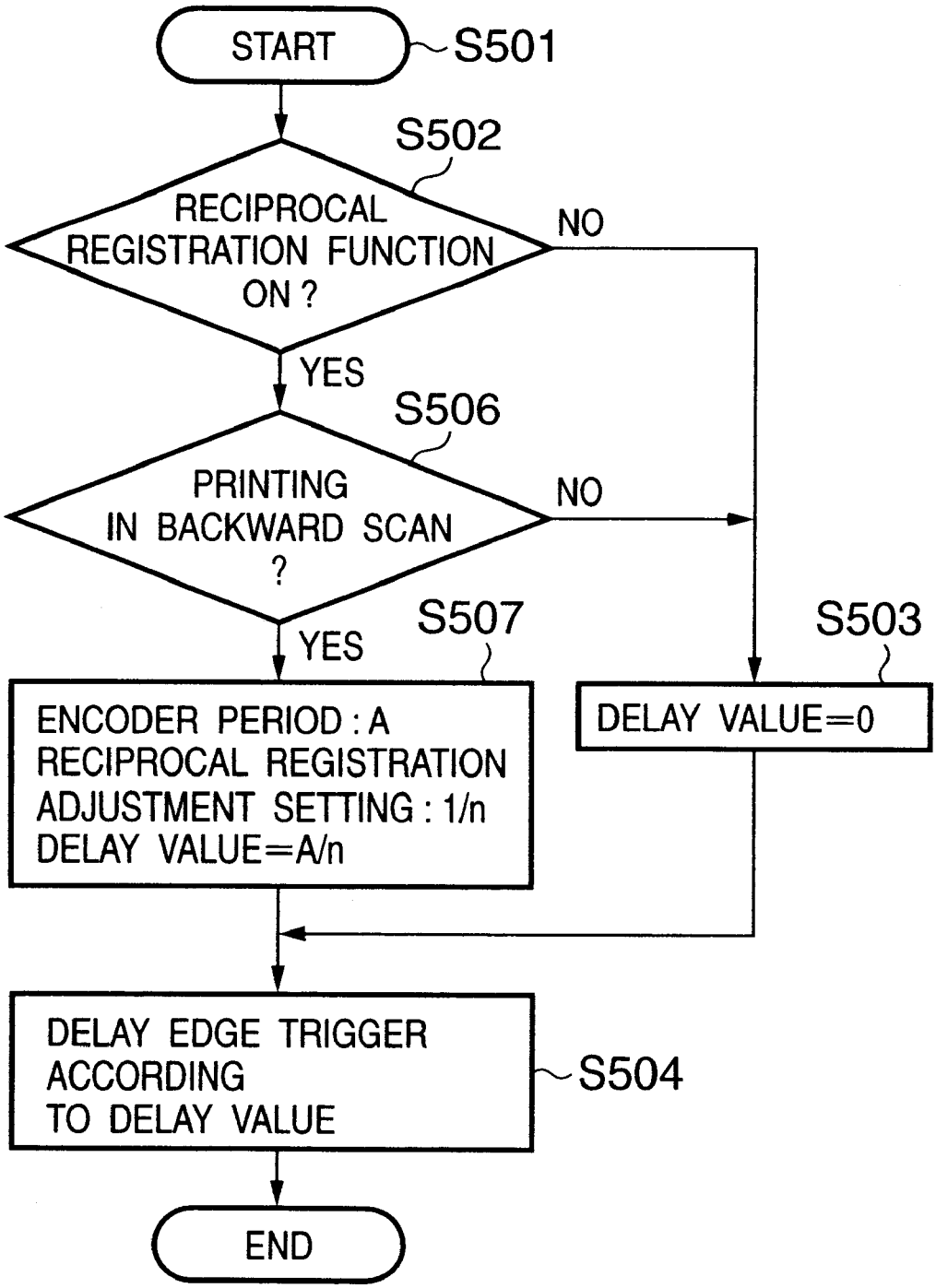
FIG. 5 is a flowchart showing processing related to calculation of a reciprocal registration amount according to the embodiment.

Furthermore, although the flowchart in FIG. 5 describes the processing of outputting one edge trigger from the edge trigger delay unit 113, in actual printing operation, the processing of steps S503, S504, and S507 is repeated.

As described above, according to the present embodiment, by virtue of the fact that printing (ink discharge) in a forward scan is performed based on a signal from the position detection means and printing (ink discharge) in a backward scan is performed with predetermined delay timing, the registration amount can coincide in the forward and backward scans. Note that in accordance with the moving speed of the carriage incorporating a printhead, the delay value becomes large when the carriage moving speed is slow, whereas the delay value becomes small when the carriage moving speed is fast. As a result, regardless of the printhead scanning speed, the amount of deviation of ink, discharged from the printhead and landed on a print medium, can be made constant based on the signal outputted from the encoder. Accordingly, reciprocal registration adjustment which is not influenced by variations of printhead scanning speed is possible.

Note that although the above embodiment employs an encoder as means for detecting a carriage movement, the present invention is not limited to this. For instance, in a construction where a carriage is moved by a stepping motor, it is possible to obtain speed information from a transfer rate of the stepping motor driving pulse, and obtain position information by counting the stepping motor driving pulse. Moreover, although the above description has been provided on registration adjustment for reciprocal printing, it is also applicable to one-way printing.

Furthermore, although the reciprocal registration adjustment parameter is obtained at the time of shipping from a factory, an adjustment mode may be provided to allow user adjustment. In addition, the reciprocal registration adjustment is not limited to be performed in reciprocal printing at constant speed.

Each of the embodiments described above has exemplified a printer, which comprises means (e.g., an electrothermal transducer, laser beam generator, and the like) for generating heat energy as energy utilized upon execution of ink discharge, and causes a change in state of ink by the heat energy, among the ink-jet printing apparatuses. According to this ink-jet printing apparatus and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand and continuous types. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention. In addition, the present invention can be effectively applied to an arrangement based on Japanese Patent Application Laid-Open No. 59-123670, which discloses the arrangement using a slot common to a plurality of electrothermal transducers as a discharge portion of the electrothermal transducers, or Japanese Patent Application Laid-Open No. 59-138461 which discloses the arrangement having an opening for absorbing a pressure wave of heat energy in correspondence with a discharge portion.

Furthermore, as a full line type printhead having a length corresponding to the maximum-width printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, as described in the above embodiment, which can be electrically connected to the apparatus main unit and can receive ink from the apparatus main unit upon being mounted on the apparatus main unit, but also a cartridge type printhead in which an ink tank is integrally arranged on the printhead itself, can be applied to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which liquefies upon application of heat energy according to a printing signal and is discharged in a liquid state, ink which begins to solidify when it reaches a printing medium, or the like, is applicable to the present invention. In this case, ink may be situated opposite to electrothermal transducers while being held in a liquid or solid state in recess portions of a porous sheet or through-holes, as described in Japanese Patent Application Laid-Open No. 54-56847 or 60-71260. In the present invention, the above-mentioned film boiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes in a computer system or apparatus (e.g., a personal computer), reading the program codes, by a CPU or MPU of the computer system or apparatus, from the storage medium, then executing the program.

In this case, the program codes read from the storage medium realize the functions according to the embodiment, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides the aforesaid functions according to the above embodiment being realized by executing the program codes which are read by a computer, the present invention includes a case where an OS (operating system) or the like working in the computer performs a part of or entire processes in accordance with designations of the program codes and realizes functions according to the above embodiment.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or entire processes in accordance with designations of the program codes and realizes functions of the above embodiment.

If the present invention is realized as a storage medium, program codes corresponding to the above-mentioned flowchart (FIG. 5) are to be stored in the storage medium.

As many apparently widely different embodiments of the present invention can be made without departing from the spirit and scope thereof, it is to be understood that the invention is not limited to the specific embodiments thereof except as defined in the claims.

What is claimed is:

1. An ink-jet printing apparatus performing printing by reciprocally scanning a carriage, incorporating a printhead, relative to a print medium, comprising:

detection means for outputting a detection signal in accordance with a predetermined distance of a movement of the carriage in a carriage scanning direction;

timing signal output means for generating a timing signal in correspondence with a period of the detection signal;

time interval detection means for timing a time interval of the detection signal;

memory means for storing as reciprocal registration adjustment information a ratio between the time interval of the detection signal and a delay time of the timing signal;

delay time setting means for obtaining the delay time of the timing signal based on the information read out from said memory means and the time interval of the detection signal when performing printing in a backward scan;

delay signal output means for outputting a delay signal, obtained by delaying the timing signal, in accordance with the delay time; and driving means for driving the printhead based on the delay signal.

2. The ink-jet printing apparatus according to claim 1, wherein the ratio between the time interval of the detection signal and the delay time of the timing signal is constant regardless of speed.

3. The ink-jet printing apparatus according to claim 1, wherein said delay time setting means sets the delay time short when the time interval is short, and sets the delay time long when the time interval is long.

4. The ink-jet printing apparatus according to claim 3, wherein said delay time setting means obtains the delay time by performing a predetermined calculation on the time interval.

5. The ink-jet printing apparatus according to claim 4, wherein the predetermined calculation obtains the delay time d by $d=a\times A/n$ (n is an integer), where A is the time interval and a is a predetermined coefficient.

6. The ink-jet printing apparatus according to claim 5, wherein n is a power of 2.

7. The ink-jet printing apparatus according to claim 1, wherein the printhead is a printhead which discharges ink by utilizing heat energy and comprises a heat energy transducer for generating the heat energy to be applied to ink.

8. A print timing setting method for an ink-jet printing apparatus, which performs printing by reciprocally scanning a carriage, incorporating a printhead, relative to a print medium and includes detection means for outputting a detection signal in accordance with a predetermined distance of a carriage movement in a carriage scanning direction, comprising the steps of:

generating a timing signal in correspondence with a period of the detection signal;

timing a time interval of the detection signal;

storing as reciprocal registration adjustment information a ratio between the time interval of the detection signal and a delay time of the timing signal in memory means;

obtaining the delay time of the timing signal based on the information read out from the memory means and the time interval of the detection signal when performing printing in a backward scan;

outputting a delay signal, obtained by delaying the timing signal, in accordance with the delay time; and driving the printhead based on the delay signal.

9. The print timing setting method according to claim 8, wherein the ratio between the time interval of the detection signal and the delay time of the timing signal is constant regardless of speed.

10. The print timing setting method according to claim 8, wherein in said delay time obtaining step, the delay time is set short when the time interval is short, and the delay time is set long when the time interval is long.

11. The print timing setting method according to claim 10, wherein in said delay time obtaining step, the delay time is obtained by performing a predetermined calculation on the time interval.

12. The print timing setting method according to claim 11, wherein the predetermined calculation obtains the delay time d by $d=a\times A/n$ (n is an integer), where A is the time interval and a is a predetermined coefficient.

13. The print timing setting method according to claim 12, wherein n is a power of 2.

14. A computer program which causes a computer to execute a print timing setting method for an ink-jet printing apparatus, which performs printing by reciprocally scanning a carriage, incorporating a printhead, relative to a print medium and includes detection means for outputting a detection signal in accordance with a predetermined distance of a carriage movement in a carriage scanning direction, said computer program comprising program codes corresponding to:

a timing signal output step of generating a timing signal in correspondence with a period of the detection signal;

a time interval detection step of timing a time interval of the detection signal;

a storing step of storing as reciprocal registration adjustment information a ratio between the time interval of the detection signal and a delay time of the timing signal in memory means;

a delay time setting step of obtaining the delay time of the timing signal based on the information read out from the memory means and the time interval of the detection signal when performing printing in a backward scan;

a delay signal output step of outputting a delay signal, obtained by delaying the timing signal, in accordance with the delay time; and a driving step of driving the printhead in accordance with the delay signal.

15. A storage medium storing a computer program that causes a computer to execute a print timing setting method for an ink-jet printing apparatus, which performs printing by reciprocally scanning a carriage, incorporating a printhead, relative to a print medium and includes detection means for outputting a detection signal in accordance with a predetermined distance of a carriage movement in a carriage scanning direction, said storage medium comprising program codes corresponding to:

a timing signal output step of generating a timing signal in correspondence with a period of the detection signal;

a time interval detection step of timing a time interval of the detection signal;

a storing step of storing as reciprocal registration adjustment information a ratio between the time interval of the detection signal and a delay time of the timing signal in memory means;

a delay time setting step of obtaining the delay time of the timing signal based on the information read out from the memory means and the time interval of the detection signal when performing printing in a backward scan;

a delay signal output step of outputting a delay signal, obtained by delaying the timing signal, in accordance with the delay time; and a driving step of driving the printhead in accordance with the delay signal.

* * * * *